US007393220B1

(12) United States Patent
Kwang

(10) Patent No.: US 7,393,220 B1
(45) Date of Patent: Jul. 1, 2008

(54) ELECTRICAL CONNECTOR ASSEMBLY CONNECTED UPON ROTATION ABOUT A BRACKET

(75) Inventor: David Kwang, Southfield, MI (US)

(73) Assignee: Yazaki North America, Inc., Canton, MI (US)

( * ) Notice: Subject to any disclaimer, the term of this patent is extended or adjusted under 35 U.S.C. 154(b) by 0 days.

(21) Appl. No.: 11/736,631

(22) Filed: Apr. 18, 2007

(51) Int. Cl.
*H01R 13/62* (2006.01)

(52) U.S. Cl. ..... 439/157; 439/372

(58) Field of Classification Search ..... 439/157, 439/152, 159, 160, 131, 341, 372
See application file for complete search history.

(56) References Cited

U.S. PATENT DOCUMENTS

| | | | | |
|---|---|---|---|---|
| 4,082,400 | A | 4/1978 | Gansert | |
| 5,273,462 | A | 12/1993 | Huser et al. | |
| 5,362,245 | A * | 11/1994 | Suguro et al. | 439/160 |
| 5,435,747 | A | 7/1995 | Franckx et al. | |
| 5,928,012 | A | 7/1999 | Kitamura | |
| 6,095,831 | A | 8/2000 | Muramatsu et al. | |
| 6,126,458 | A | 10/2000 | Gregory, II et al. | |
| 6,254,414 | B1 * | 7/2001 | Sawayanagi et al. | 439/310 |
| 6,276,948 | B1 * | 8/2001 | Okabe | 439/157 |
| 6,547,574 | B2 * | 4/2003 | Sasaki et al. | 439/157 |
| 6,644,991 | B2 | 11/2003 | Martin | |
| 6,648,678 | B1 | 11/2003 | Kaneko | |
| 6,783,380 | B1 * | 8/2004 | Kamath et al. | 439/247 |
| 7,004,784 | B2 | 2/2006 | Castle | |
| 7,090,518 | B1 | 8/2006 | Osada et al. | |
| 7,329,132 | B1 * | 2/2008 | Kamath et al. | 439/157 |
| 2001/0046797 | A1 | 11/2001 | Sasaki et al. | |
| 2005/0037661 | A1 | 2/2005 | Tanacan et al. | |
| 2005/0048834 | A1 | 3/2005 | Kiyota et al. | |

* cited by examiner

*Primary Examiner*—Renee S Luebke
*Assistant Examiner*—Vanessa Girardi
(74) *Attorney, Agent, or Firm*—Harness, Dickey & Pierce, PLC.

(57) ABSTRACT

A connector assembly can include a bracket, a first connector and a second connector. The bracket can have a base adapted to be mounted in a fixed position and include a wall extending at a right angle from a plane of the base. The wall can have two curved, side-by-side grooves and an axis raised above the plane of the base. The first and second connectors can each have a housing for accommodating electrical terminals. One housing can include two posts located alongside each other for receipt in the grooves of the bracket such that the first connector is guided in a stable, curved sliding movement along the grooves. The second connector can include a channel for receiving and being acted upon by the axis of the bracket to draw the connectors further together and the terminals of the connectors into electrical engagement to a final position.

20 Claims, 8 Drawing Sheets

ELECTRICAL CONNECTOR ASSEMBLY CONNECTED UPON ROTATION ABOUT A BRACKET

FIELD

The present disclosure relates generally to electrical connectors and more specifically to a connector assembly having a first and second electrical connector that are electrically connected upon rotation about a bracket without the need for supplemental fasteners.

BACKGROUND

Bussed electrical centers (BECs), also known as power distribution centers or junction boxes can be used in automotive vehicles to simplify electrical system wiring by eliminating multi-branch wiring, consolidating fuses, relays and other electrical circuit components in a single location. In one example, a BEC can include a plastic case having complementary upper and lower housing portions. A multitude of sockets can be formed in the BEC for receiving the circuit components. The plastic case can include bus bars, printed circuit boards (PCBs) or other conductive elements for interconnecting and supplying power to the various circuit components. Electrical connectors can be disposed on the BEC to receive mating connectors. Such mating connectors can terminate wire harnesses extending throughout the vehicle to interconnect the circuitry of the BEC with various electrical systems and devices within the vehicle.

In many applications, mechanical fasteners can be provided for securing the upper and lower housing portions together. As can be appreciated, the use of fasteners can be time consuming and require special torque installation requirements. In one example, torque guns can be provided for installation of such fasteners during assembly.

SUMMARY

A connector assembly can include a bracket, a first connector and a second connector. The bracket can have a base adapted to be mounted in a fixed position and include a wall extending at a right angle from a plane of the base. The wall can have two curved, side-by-side grooves and an axis raised above the wall and the plane of the base.

The first connector can have a first housing for accommodating electrical terminals. The first housing can include two posts located alongside each other for receipt in the grooves of the bracket such that the first connector is guided in a stable, curved sliding movement along the grooves.

The second connector can have a first housing for accommodating electrical terminals. The second housing can be sized to fit around the first connector in an initial position with the terminals of the first connector and the second connector not engaged. The second connector can include a channel for receiving and being acted upon by the axis of the bracket to draw the first and second connectors further together and the terminals of the first and second connectors into electrical engagement as the second connector is pushed toward the plane of the bracket and the first connector is guided by the posts and the grooves of the bracket to a final position.

According to additional features, a window can be formed in the second connector for viewing the axis of the bracket when the first and second connectors are in the final position. The axis can be defined by finger portions extending generally perpendicularly from the wall. The second connector can define a ramped portion wherein the finger portions slidably engage the ramped portion while the second connector is pushed toward the plane of the bracket to the final position.

According to still other features, the ramped portion can be linear. The first connector can define a pair of opposing walls defining a central opening of the first connector. The wall of the bracket can be received through the central opening in the final position.

Further areas of applicability of the present disclosure will become apparent from the detailed description provided hereinafter. It should be understood that the detailed description and specific examples, while indicating the preferred embodiment of the disclosure, are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION OF EXEMPLARY EMBODIMENTS

The following description is merely exemplary in nature and is in no way intended to limit the disclosure, its application, or uses.

Figure 1:
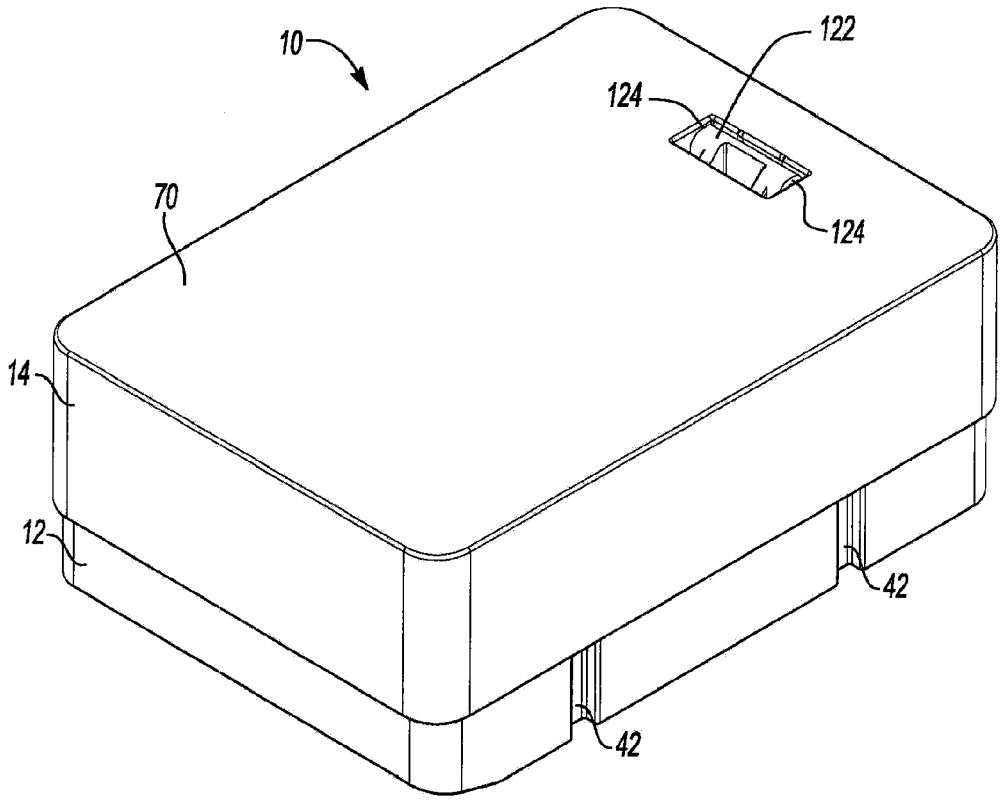
FIG. 1 is a perspective view of a connector assembly constructed in accordance to the present teachings and shown in an assembled position.
Figure 2:
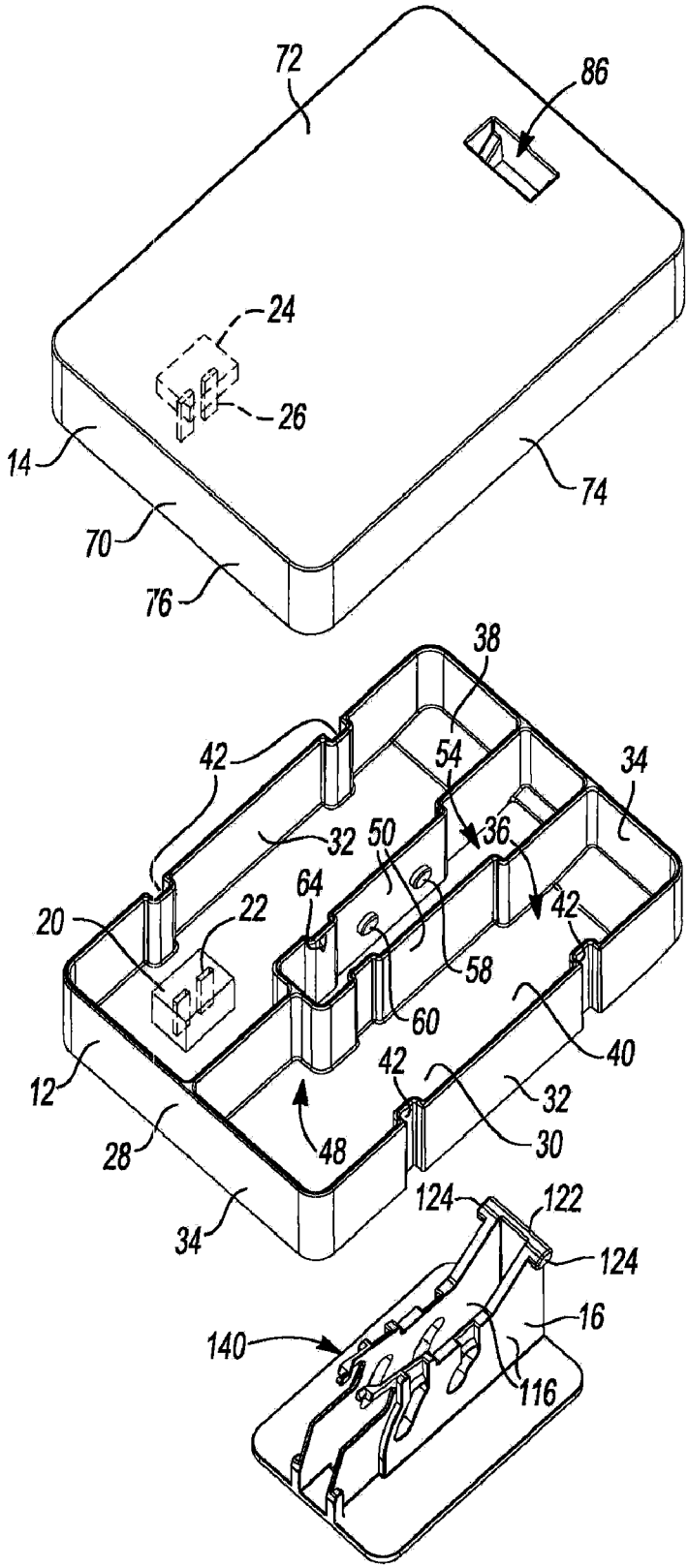
FIG. 2 is an exploded view of the connector assembly of FIG. 1 illustrating a BEC, a retainer and a bracket.

With initial reference to FIGS. 1 and 2, an exemplary connector assembly according to the present teachings is shown and generally identified at reference number 10. The connector assembly 10 can generally include a first connector 12, a second connector 14 and a bracket 16. In the example shown, the first connector 12 is in the form of a retainer and the second connector 14 is in the form of a Bussed Electrical Center (BEC). The first connector 12 can include a first electrical component 20 having first terminals 22. The second connector 14 can include a second electrical component 24 having second terminals 26. It is appreciated that the first and second electrical components 20 and 24, respectively, are generically depicted for simplicity. In this way, the electrical components 20 and 24 may comprise other mating shapes and/or sizes. While not specifically shown, the connector assembly 10 can also include additional electrical connectors, various busbars, printed circuit boards, relays, fuses and other components. As will be described in detail herein, the connector assembly 10 is movable from an initial position (FIG. 9) wherein the respective first and second terminals 22 and 26 are not electrically connected to a final position (FIG. 12) wherein the respective first and second terminals 22 and 26 are in electrical communication.

Figure 3:
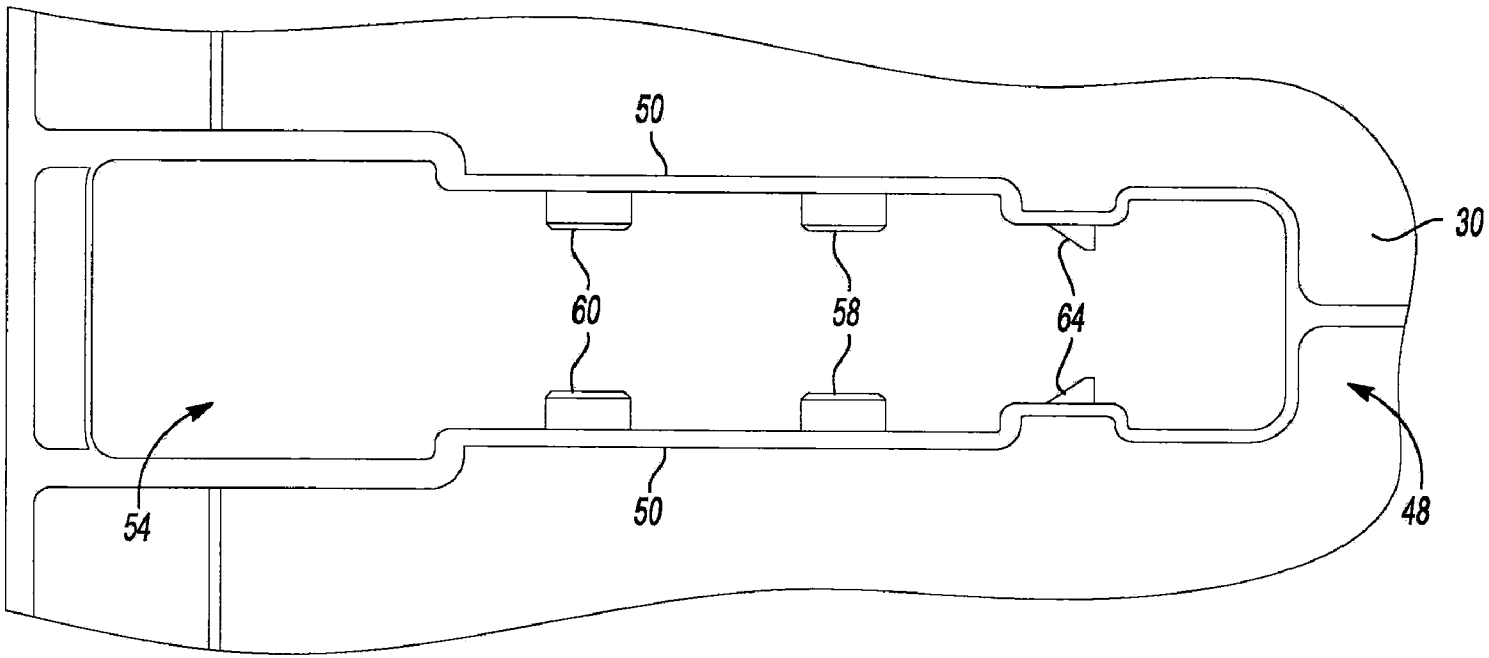
FIG. 3 is a plan view of a portion of the retainer shown in FIG. 2.

With continued reference to FIG. 2 and additional reference to FIG. 3, the first connector 12 will be described in greater detail. The first connector 12 can generally include a first housing 28 having a retainer base 30, a first pair of outer walls 32 and a second pair of outer walls 34. The first and second pairs of outer walls 32 and 34 can cooperate to define an opening 36. In the example shown, the first pair of outer walls 32 are parallel to each other and the second pair of outer walls 34 are parallel to each other. The base 30 can define an angled surface 38 on one end (best shown in FIG. 7). The angled surface 38 can define an angle relative to a bottom surface 40 of the retainer base 30 whose magnitude is less than 90 degrees.

The first pair of outer walls 32 can define male engagement portions 42. The first connector 12 can define a central divider 48. A portion of the central divider 48 can include a pair of opposing walls 50 extending generally parallel to the first pair of outer walls 32. A central opening 54 can be defined through the retainer base 30 and between the pair of opposing walls 50. A first and second pair of opposing posts 58 and 60, respectively, can be formed on the opposing walls 50 (as best viewed in FIG. 3). A pair of preset engaging tabs 64 can be formed on the pair of opposing walls 50. The first connector 12 can be formed of rigid lightweight material such as plastic.

Figure 4:
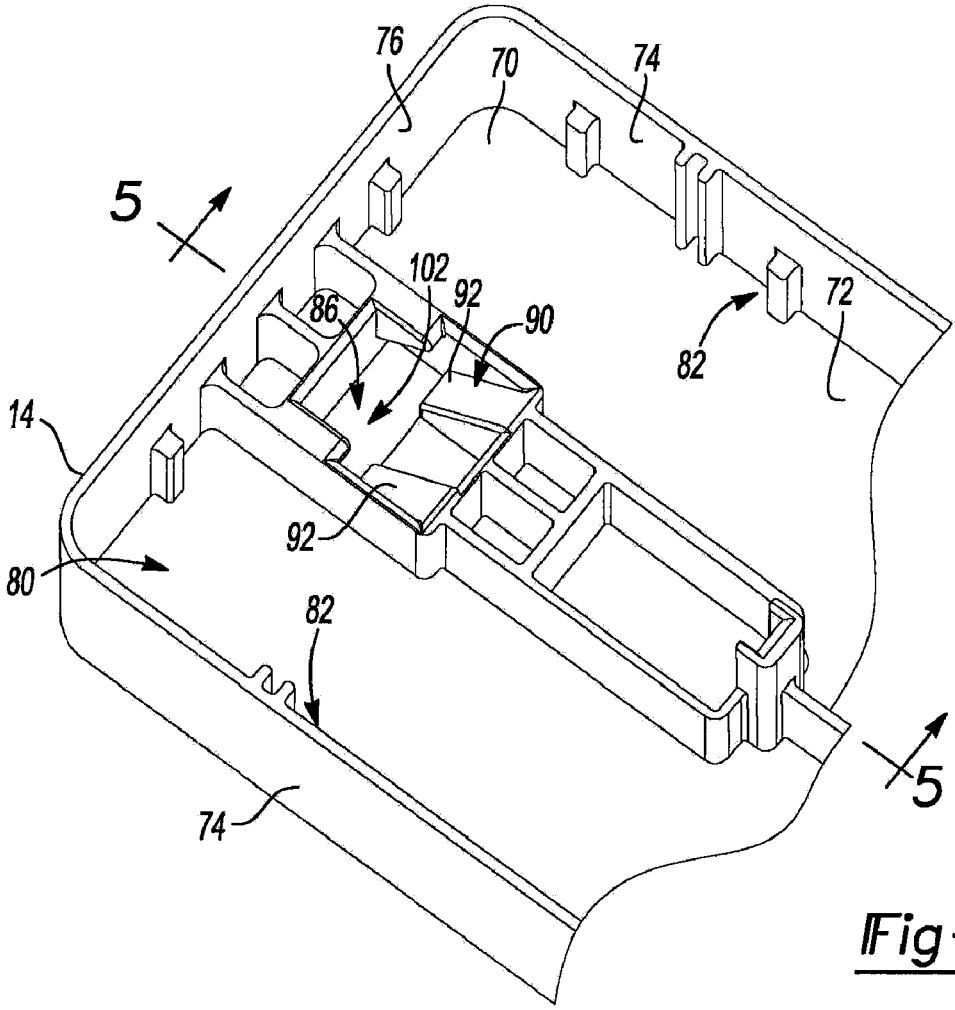
FIG. 4 is a perspective view of a portion of a housing of the BEC shown in FIG. 2.
Figure 5:
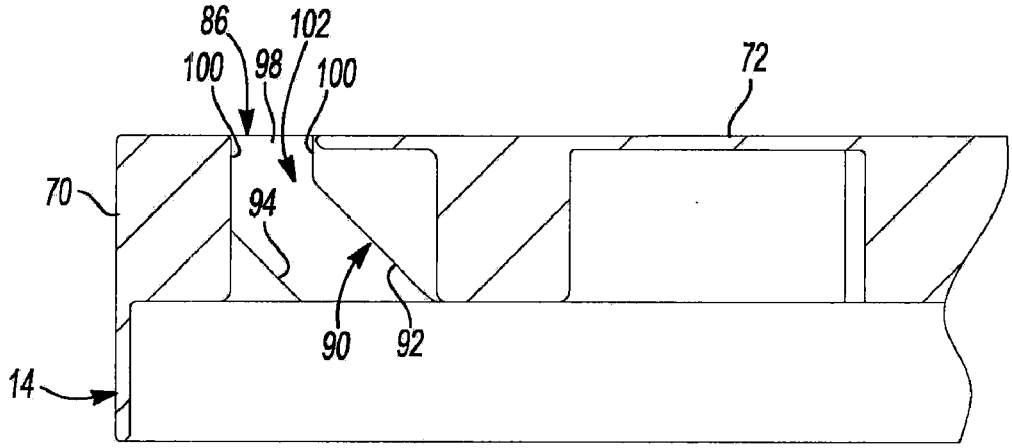
FIG. 5 is a sectional view of the BEC housing taken along line 5-5 of FIG. 4.

With continued reference to FIG. 2 and additional reference to FIGS. 4 and 5, the second connector 14 will be described in greater detail. The second connector 14 can generally include a second housing 70 having a BEC cover 72, a first pair of outer walls 74 and a second pair of outer walls 76. The first and second pairs of outer walls 74 and 76 can cooperate to define an opening 80. In the example shown, the first pair of outer walls 74 are parallel to each other and the second pair of outer walls 76 are parallel to each other. The first pair of outer walls 74 can define female engagement portions 82. The second connector 14 can define a window 86 formed through the cover 72.

A ramped portion 90 can be formed on the second connector 14. The ramped portion 90 can include a first pair of linear walls 92 and a second pair of linear walls 94. In one example, the first pair of linear walls 92 can be parallel to the second pair of linear walls 94 (FIG. 5). The respective first and second pairs of linear walls 92 and 94 can define an angle with respect to a plane defined by the BEC cover 72 (FIG. 5). A chimney 98 defined by a pair of chimney walls 100 can be formed between the window 86 and the ramped portion 90. The ramped portion 90 and chimney 98 can collectively define a channel 102. The second connector 14 can be formed of rigid lightweight material such as plastic.

Figure 6:
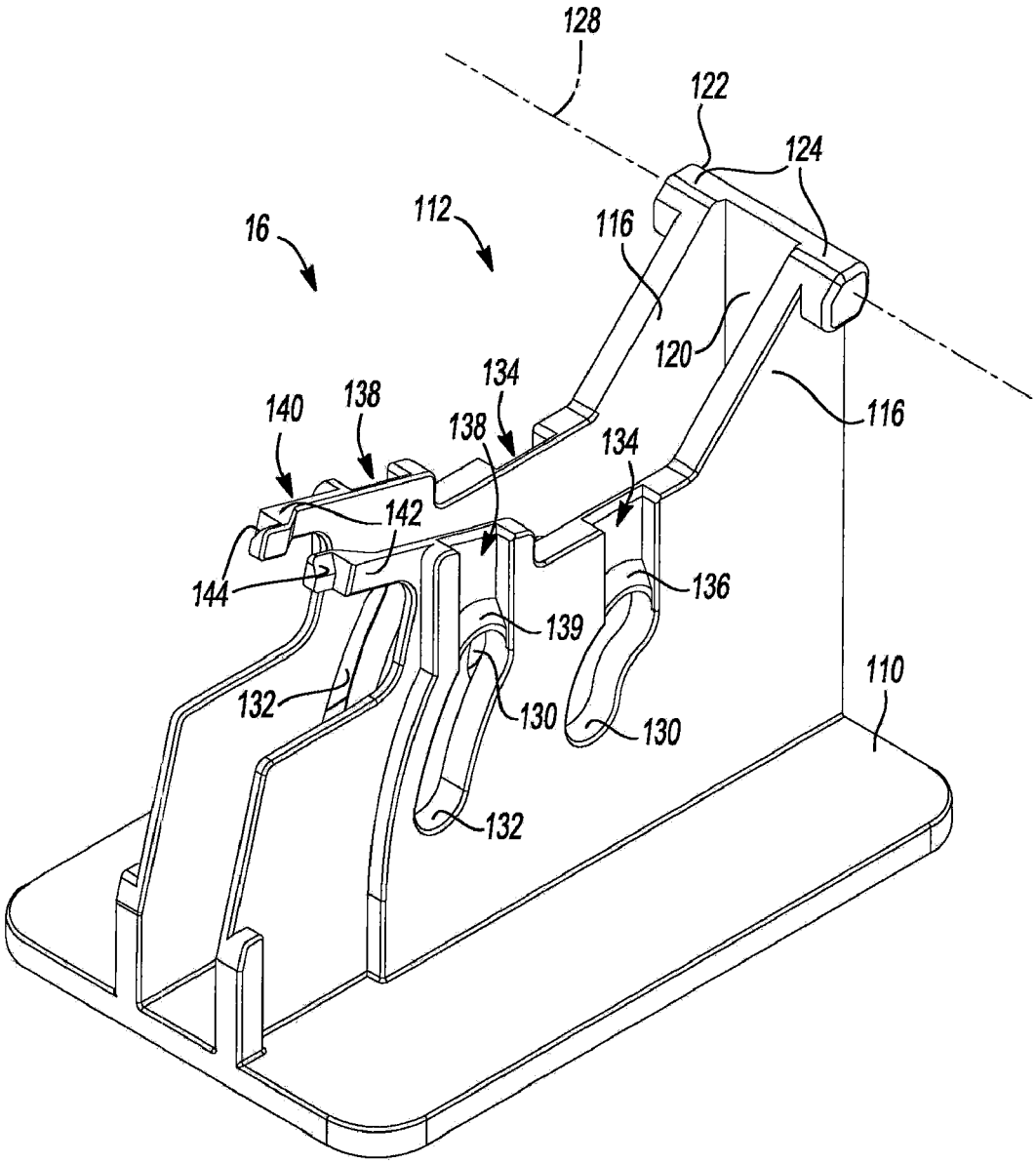
FIG. 6 is a perspective view of the bracket of FIG. 2.
Figure 7:
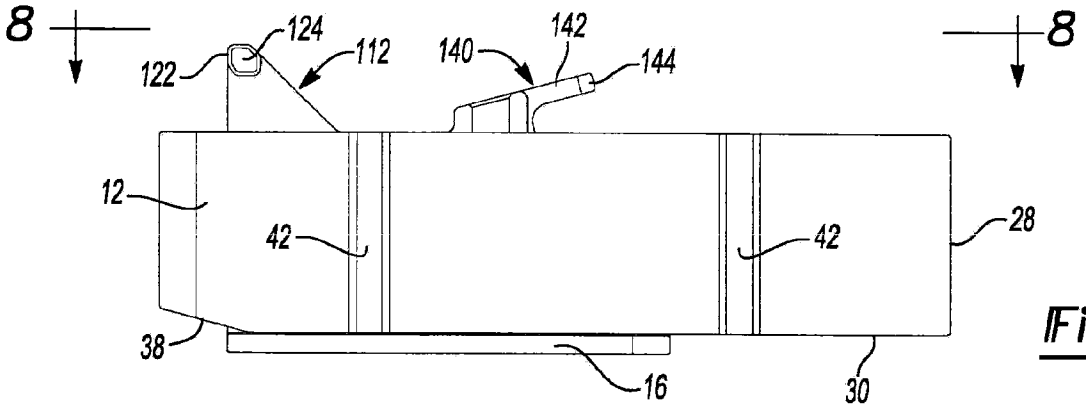
FIG. 7 is a side view of the retainer shown in a horizontal position relative to the bracket.
Figure 8:
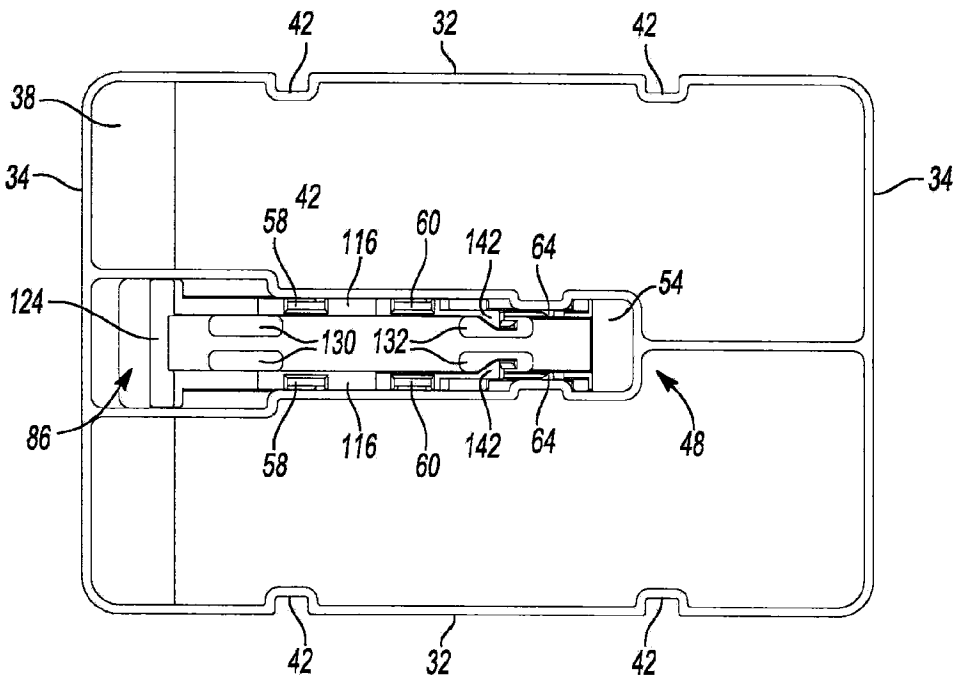
FIG. 8 is a plan view of the retainer and bracket as viewed from line 8-8 of FIG. 7.

With specific reference now to FIGS. 6-8, the bracket 16 will be described in greater detail. The bracket 16 can generally define a base 110 and a fin portion 112. In a final or assembled position, the fin portion 112 can be received by the central opening 54 of the first connector 12 (FIG. 8). The fin portion 112 can include a pair of upright walls 116 and a forward wall 120. In the example shown, the upright walls 116 can extend in a generally perpendicular direction relative to a plane defined by the base 110. The forward wall 120 can extend between the upright walls 116. A lever indicator 122 can be formed by a pair of finger portions 124 extending at an upper portion of the forward wall 120. The finger portions 124 can define an axis 128 that is generally perpendicular to the upright walls 116. A first and second pair of grooves 130 and 132 can be defined in the upright walls 116. The first pair of grooves 130 can oppose each other and generally define an arcuate path. Similarly, the second pair of grooves 132 can oppose each other and define an arcuate path. In general, the first and second pair of grooves 130 and 132 can extend in a clockwise curved path (as viewed in FIG. 6), away from the base 110 and toward the forward wall 120. A first pair of chutes 134 can be defined in the upright walls 116 that generally terminate at first entrance ramps 136 defined adjacent the first pair of grooves 130. A second pair of chutes 138 can be defined in the upright walls 116 and terminate at second entrance ramps 139 at the second pair of grooves 132.

A preset mechanism 140 can be formed on the upright walls 116. The preset mechanism 140 can include a pair of arms 142 extending from the upright walls 116. Angled surfaces 144 can be formed on the arms 142 that generally slope outwardly and away from each other toward the bracket base 110. The bracket 16 can be formed of rigid lightweight material such as plastic. The arms 142 can define a cross-section suitable to permit inward deformation (i.e., in a direction toward each other) upon application of force as will be described in further detail herein.

Figure 9:
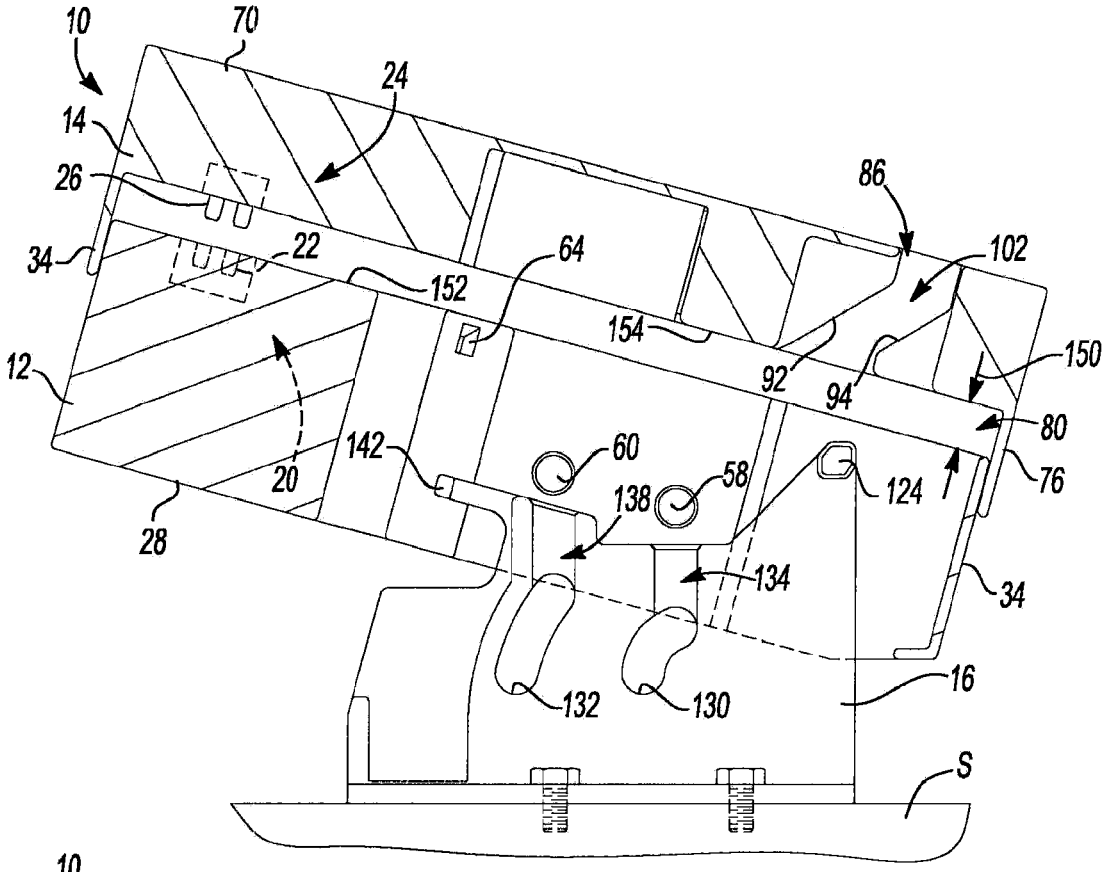
FIG. 9 illustrates a side view of the connector assembly with the BEC and retainer laterally offset above the bracket in an unassembled position.

With reference now to FIGS. 9-12, assembly of the connector assembly 10 will be described. At the outset, the base 110 of the bracket 16 can be mounted in a fixed position to a suitable structure S in any appropriate manner such as threaded fastening. The second connector 14 can be positioned relative to and placed in initial contact with the first connector 12 at a first position (FIG. 9). At the first position, the opening 80 defined by respective outer walls 74, 76 of the second connector 14 can receive the respective outer walls 32, 34 of the first connector 12. At this point, as shown in FIG. 9, the terminals 22 of the respective first electrical component 20 are not in electrical communication with the terminals 26 of the second electrical component 24. A gap 150 is defined between an upper edge 152 of the first connector 12 and a lower edge 154 of the second connector 14. At this point, the fin 112 of the bracket 16 can be aligned for receipt within the central opening 54 of the first connector 12, however, the bracket 16 and first connector 12 do not necessarily need to touch in the first position.

Figure 10:
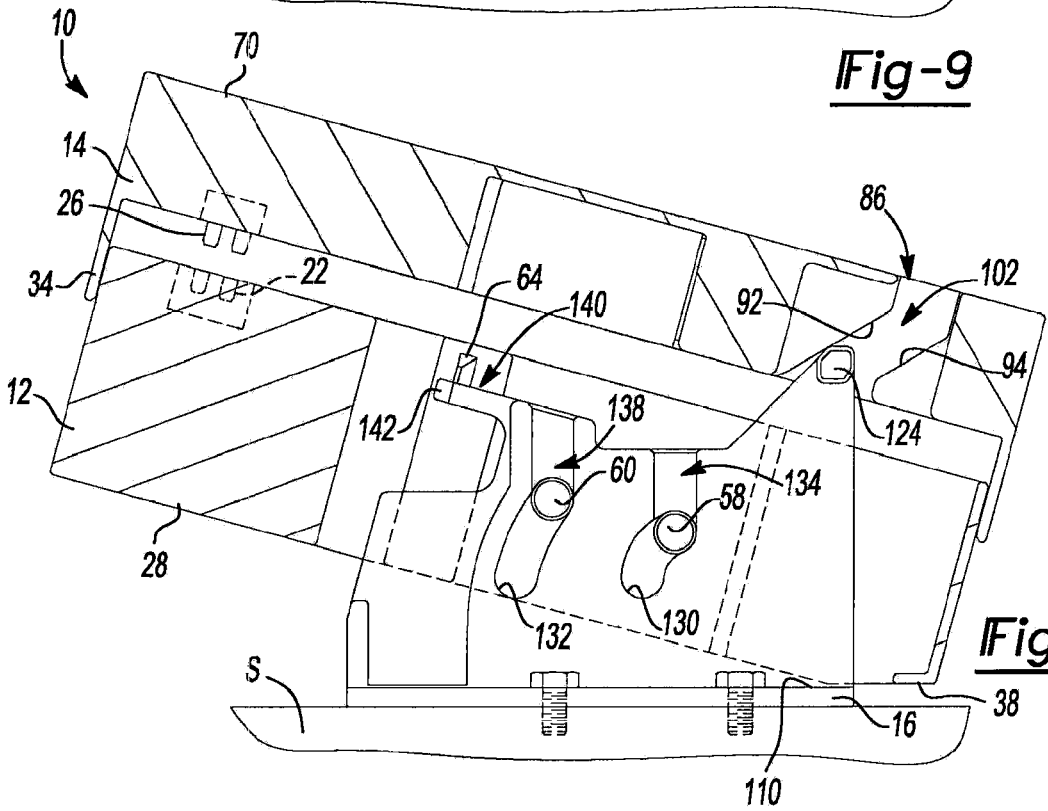
FIG. 10 is a side view of the connector assembly of FIG. 9 with the BEC and retainer assembly moved laterally downwardly until a preset lock defined on bracket engages a portion of the retainer in a preset position.

The first and second connectors 12 and 14 can be rotated relative to the bracket 16 into a second position that is shown in FIG. 10. During movement from the first position (FIG. 9) to the second position (FIG. 10), the first and second pair of posts 58 and 60 can be guided along the respective chutes 134, 138 of the bracket 16. In the second position, the first and second connectors 12, 14 are collectively moved into engagement with the bracket 16. More specifically, the arms 142 of the preset mechanism 140 can engage the preset engaging tabs 64 of the first connector 12. In addition, the finger portions 124 of the lever indicator 122 can engage the first pair of linear walls 92. The collective engagement of the preset mechanism 140 with the first connector 12 and the lever indicator 122 with the second connector 14 can cause the first and second connectors 12 and 14 to rest statically in a generally angled position relative to the bracket base (FIG. 10). In this position, the angled surface 38 of the first connector 12 can also engage the bracket base 110. In the second position, the respective terminals 22 and 26 may not be in electrical engagement.

In order to advance the first and second connector 12 and 14 beyond the second position and toward a third position (FIG. 11), a user can apply force onto one of the first and second connectors 12 and 14 in a direction generally toward the bracket base 110. As described above, the arms 142 of the preset mechanism 140 can engage the tabs 64 of the first connector 12 in the second position or preset position (FIG. 10). Once sufficient force is applied, the angled surfaces 144 of the arms 142 can begin to ride along the tabs 64 formed on the first connector 12. During this motion, the arms 142 can begin to bow slightly inward (toward each other) until the respective angled surfaces 144 pass over the tabs 64. Of note, the collective mass of the first and second connector 12 and 14 can facilitate ease of insertion force requirements from the second position (FIG. 10) through the final position (FIG. 12).

Figure 11:
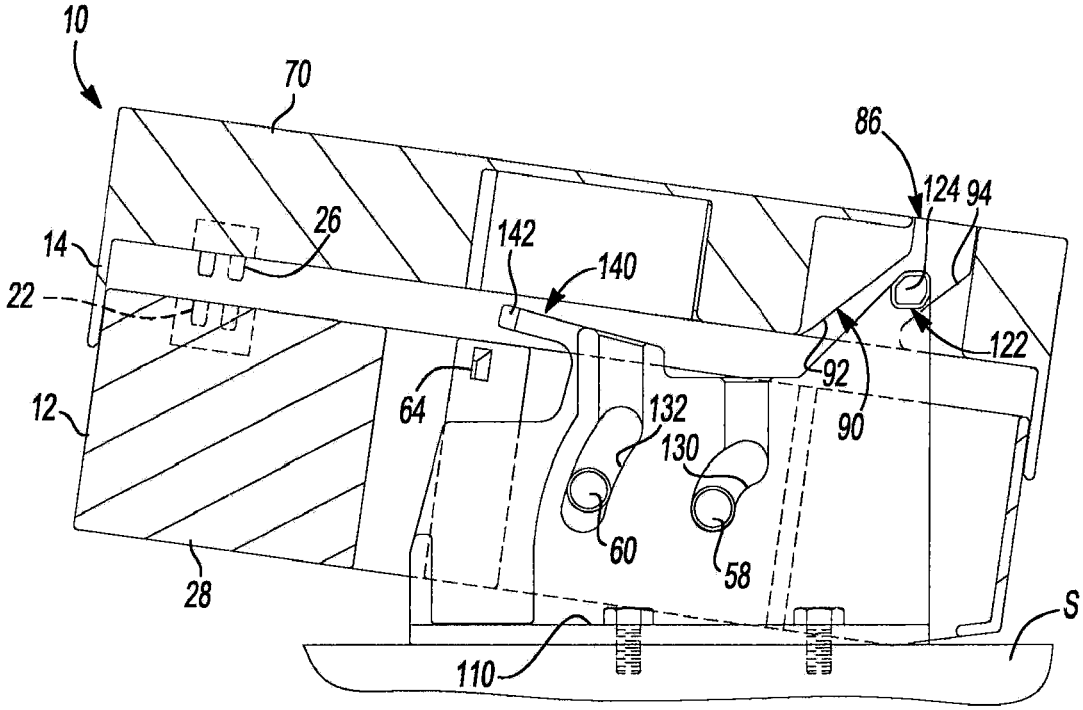
FIG. 11 is a side view of the connector assembly of FIG. 10 shown with the BEC and retainer assembly rotating along grooves formed on the bracket toward an engaged position.

With reference to FIG. 11, the connector assembly 10 is shown in a third position. During movement from the second position (FIG. 10) to the third position (FIG. 11), the respective first and second pairs of posts 58, 60 can ride along the arcuate grooves 130, 132 of the bracket 16. Concurrently, the finger portions 124 of the lever indicator 122 may transition from engagement with the first pair of linear walls 92 of the ramped portion 90 to engagement with the second pair of linear walls 94. In the third position, the respective terminals 22 and 26 may not be in electrical engagement.

Figure 12:
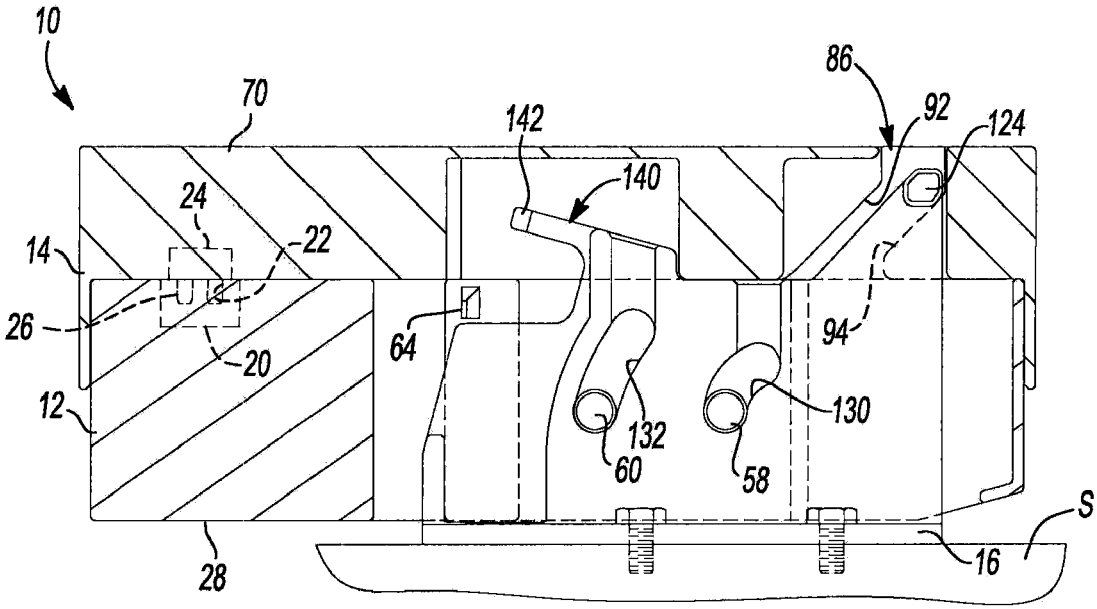
FIG. 12 is a side view of the connector assembly of FIG. 11 shown with first and second terminals mated in the assembled position.

Turning now to FIG. 12, the connector assembly 10 is shown in a fourth or final position. During movement from the third position (FIG. 11) to the fourth position (FIG. 12), the respective posts 58, 60 can continue to ride along the arcuate grooves 130, 132 of the bracket 16. Furthermore, the male engagement portions 42 (FIG. 2) formed on the first connector 12 can be slidably accepted between the female engagement portions 82 (FIG. 4) of the second connector 14. In the final position, the respective terminals 22 and 26 can be electrically connected and the first and second connectors 12 and 14 can be in a secure mated position. Clips (not shown) can additionally be provided for securing the connector assembly in the final position. In addition, the fingers 124 of the lever indicator 122 can be viewed through the window 86 of the second connector 14 (FIG. 1).

While the disclosure has been described in the specification and illustrated in the drawings with reference to various embodiments, it will be understood by those skilled in the art that various changes may be made and equivalents may be substituted for elements thereof without departing from the scope of the disclosure as defined in the claims. Furthermore, the mixing and matching of features, elements and/or functions between various embodiments is expressly contemplated herein so that one of ordinary skill in the art would appreciate from this disclosure that features, elements and/or functions of one embodiment may be incorporated into another embodiment as appropriate, unless described otherwise above. Moreover, many modifications may be made to adapt a particular situation or material to the teachings of the disclosure without departing from the essential scope thereof. Therefore, it is intended that the disclosure not be limited to the particular embodiment illustrated by the drawings and described in the specification as the best mode presently contemplated for carrying out this disclosure, but that the disclosure will include any embodiments falling within the foregoing description and the appended claims.

What is claimed is:

1. A connector assembly comprising:

a bracket having a base adapted to be mounted in a fixed position, the bracket including at least one wall extending at a right angle from a plane of the base, the at least one wall having two curved, side-by-side grooves and an axis raised above the at least one wall and the plane of the base;

a first connector having a first housing for accommodating electrical terminals, the first housing including two posts located alongside each other for receipt in the grooves of the bracket such that the first connector is guided in a stable, curved sliding movement along the grooves; and a second connector having a second housing for accommodating electrical terminals, the second housing being sized to fit around the first housing in an initial position such that the terminals of the first connector and the second connector not engaged, the second connector including a channel for receiving and being acted upon by the axis of the bracket to draw the first and second connectors further together and the terminals of the first and second connectors into electrical engagement as the second connector is pushed toward the plane of the bracket and the first connector is guided by the posts and the grooves of the bracket to a final position.

2. The connector assembly of claim 1, further comprising a window in the second connector for viewing the axis of the bracket when the first and second connectors are in the final position.

3. The connector assembly of claim 1 wherein the first connector housing defines one of a male and female engagement portion for slidably mating with the other of a male and female engagement portion defined on the second connector housing during movement from the initial position to the final position.

4. The connector assembly of claim 1 wherein the axis is defined by finger portions extending generally perpendicularly from the at least one wall.

5. The connector assembly of claim 4 wherein the second connector defines a ramped portion wherein the finger portions slidably engage the ramped portion while the second connector is pushed toward the plane of the bracket to the final position.

6. The connector assembly of claim 5 wherein the ramped portion is linear.

7. The connector assembly of claim 1 wherein the first connector defines a pair of opposing walls defining a central opening of the first connector wherein the at least one wall of the bracket is received through the central opening in the final position.

8. The connector assembly of claim 7 wherein a plane defined by the first connector housing defines an angle relative to the plane of the bracket base in the initial position.

9. The connector assembly of claim 7 wherein the pair of opposing walls of the first connector define at least one tab extending generally into the central opening, the at least one tab engaging at least one arm formed on the bracket to maintain the first connector at the initial position.

10. The connector assembly of claim 9 wherein the at least one arm is urged away from engagement with the at least one tab upon application of force onto one of the first and second connector toward the base.

11. A connector assembly comprising:

a bracket having a base adapted to be mounted in a fixed position, the bracket including a wall having an arcuate groove and a finger portion extending from the wall;

a first connector having a first housing for accommodating electrical terminals, the first housing including a post located for receipt in the groove of the bracket such that the first connector is guided in a stable, arcuate sliding movement along the groove; and a second connector having a second housing for accommodating electrical terminals, the second housing sized to fit adjacent to the first connector in an initial position such that the terminals of the first connector and the second connector are not engaged, the second connector including a linear ramp portion, wherein the finger portion slidably advances along the linear ramp portion during the arcuate sliding movement of the post along the groove to draw the first and second connectors further together and the terminals of the first and second connectors into electrical engagement in a final position.

12. The connector assembly of claim 11 wherein a plane defined by the first connector housing defines an angle relative to a plane of the bracket base in the initial position.

13. The connector assembly of claim 11 wherein the first connector housing defines one of a male and female engagement portion for slidably mating with the other of a male and female engagement portion defined on the second connector housing during movement from the initial position to the final position.

14. The connector assembly of claim 11, further comprising a window formed in the second connector for viewing the finger of the bracket when the first and second connectors are in the final position.

15. The connector assembly of claim 14 wherein the first connector defines a pair of opposing walls defining a central opening of the first connector wherein the wall of the bracket is received through the central opening in the final position.

16. The connector assembly of claim 15 wherein the pair of opposing walls of the first connector define at least one tab extending generally into the central opening, the at least one tab engaging at least one arm formed on the bracket to maintain the first connector at the initial position.

17. The connector assembly of claim 16 wherein the at least one arm is urged away from engagement with the at least one tab upon application of force onto one of the first and second connector toward the base.

18. A connector assembly comprising:

a bracket having a base adapted to be mounted in a fixed position, the bracket including a wall having an arcuate groove and a finger portion extending from the wall;

a first connector having a first housing for accommodating electrical terminals, the first housing including a post located for receipt in the groove of the bracket such that the first connector is guided in a stable, arcuate sliding movement along the groove;

a second connector having a second housing for accommodating electrical terminals, the second housing sized to fit in contact with the first connector in an initial position such that the terminals of the first connector and the second connector are not engaged, the second connector including a ramp portion, wherein the finger portion slidably advances along the ramp portion during the arcuate sliding movement of the post along the groove drawing the first and second connectors further together and the terminals of the first and second connectors into electrical engagement in a final position; and a preset mechanism including complementary engaging portions defined on the bracket and first connector respectively, the complementary engaging portions contacting each other in the initial position to maintain a first plane defined by the first housing at an angle relative to a second plane defined by the base of the bracket.

19. The connector assembly of claim 18, further comprising a window formed in the second connector for viewing the finger portion of the bracket when the first and second connectors are in the final position.

20. The connector assembly of claim 18 wherein the first connector defines a pair of opposing walls defining a central opening of the first connector wherein the wall of the bracket is received through the central opening in the final position.

* * * * *